United States Patent [19]

Vignon

[11] Patent Number: 4,947,632

[45] Date of Patent: Aug. 14, 1990

[54] CAP SPINNING MACHINE

[76] Inventor: Louis Vignon, Chemin de Vincy 5, CH-1201 Geneva, Switzerland, CH-1201

[21] Appl. No.: 315,571

[22] Filed: Feb. 27, 1989

[30] Foreign Application Priority Data

Feb. 29, 1988 [CH] Switzerland ..... 742/88

[51] Int. Cl.[5] ..... D01H 7/66; D01H 13/00

[52] U.S. Cl. ..... 57/74; 57/88; 57/105

[58] Field of Search ..... 57/74, 88, 104, 105, 57/127, 130

[56] References Cited

U.S. PATENT DOCUMENTS

| | | | |
|---|---|---|---|
| 1,618,519 | 2/1927 | De Roysancour | 57/74 |
| 2,655,782 | 10/1953 | Cutler | 57/105 |
| 2,833,111 | 5/1958 | Hadlich | 57/74 |
| 2,837,889 | 6/1958 | Comer | 57/104 |
| 3,461,660 | 8/1969 | Nimtz et al. | 57/105 |
| 4,437,300 | 3/1984 | Vignon | 57/74 |
| 4,592,196 | 6/1986 | Wolf | 57/74 |
| 4,606,186 | 8/1986 | Stahlecker | 57/104 X |
| 4,627,228 | 12/1986 | Wolf | 57/105 X |

FOREIGN PATENT DOCUMENTS

| | | | |
|---|---|---|---|
| 3046180 | 7/1982 | Fed. Rep. of Germany . | |
| 1318911 | 1/1963 | France | 57/104 |

*Primary Examiner*—Joseph J. Hall, III

*Attorney, Agent, or Firm*—Young & Thompson

[57] ABSTRACT

The machine comprises a series of rotatable spindles (3), each of these being associated with respectively one cap-shaped thread guide member (7) rotatable about the spindle axis. A first drive belt (5) serves for turning the spindles (3). A second belt (12) is in contact with whorls (11) on the thread guide members (7). A device exerting contact pressure (13, 14, 15) urges the second belt (12) during operation against the whorls (11) with an adjustable force so that the belt (12) exerts, by means of friction, a small braking force on the whorls (11) running faster than the belt (12). The contact pressure device (13, 14, 15) can be switched over in order to press the second belt (12) against the whorls (11) with a substantially greater force. Upon shutoff of the spinning machine, the contact pressure device (13, 14, 15) is switched over so that the decelerating second belt (12) exerts a substantially greater friction force on whorls (11) and rapidly brakes the thread guide members (7) concomitantly.

7 Claims, 1 Drawing Sheet

CAP SPINNING MACHINE

FIELD OF THE INVENTION

The invention relates to a cap spinning machine.

BACKGROUND OF THE INVENTION

Cap spinning machines with driven spindles and cap-shaped thread guide members rotatable about the spindle axles have been known for a long time. The rotatable thread guide members in such machines do not require their own drive mechanism, in principle, but rather can be entrained by the thread passing through an opening at the free rim of the thread guide member and being wound up on the bobbin disposed on the spindle, in a similar way as the rotor in a ring spinning machine.

However, frequently an auxiliary drive means is nevertheless provided for the cap-shaped thread guide members, this drive means initially providing a faster startup of the machine (acceleration of the relatively sluggish thread guide member) and optionally also providing additional aid during operation in overcoming friction. In order to enable the number of revolutions of the thread guide member to adapt, during operation, to the increasing yarn package diameter—at constant spindle speed and constant thread feeding speed— DE-A No. 3,040,180 suggests to provide whorls on the thread guide members, these whorls being in contact with a drive belt and being individually coupled with the associated thread guide member by way of a freewheel mechanism.

However, problems are encountered in such machines during shutoff. The thread guide member, having a relatively great inertia, has the tendency of continuing rotation longer than the spindle.

OBJECT OF THE INVENTION

It is an object of the invention to design, in a cap spinning machine of the above-discussed type, the auxiliary drive mechanism driving the thread guide members during startup of the machine in such a way that during cutoff of the machine the thread guide members are braked more rapidly—and approximately with the same retardation as the spindles. In this connection, the possibility is also to be provided that, during operation, the number of revolutions of the thread guide members adapts itself to the increasing yarn package diameters.

This object has been attained according to the invention by the device as described hereinafter.

SUMMARY OF THE INVENTION

The spindle drive unit and the belt are suitably driven by a joint drive mechanism at speeds that are in a fixed proportion to each other, namely in such a way that the belt runs somewhat more slowly during operation than the periphery of the whorls moves on the thread guide members entrained by the thread. The thread guide members are then slightly braked during operation by the belt due to friction, the braking force being dependent on the adjustable contact pressure exerted on the belt. Upon shutting off the machine, the contact pressure is then increased so that the thread guide members cease operation and come to a standstill approximately in synchronism with the belt, in spite of their relatively great inertia.

The device for exerting contact pressure on the belt can be realized in a simple way by pressure rollers movable transversely to the belt and operated by a joint control element. The control element herein can suitably be a control rod movable in parallel to the belt between two end positions.

BRIEF DESCRIPTION OF THE DRAWING

One embodiment of the invention will be described in greater detail below with reference to the drawing wherein.

DETAILED DESCRIPTION OF THE INVENTION

Figure 1:
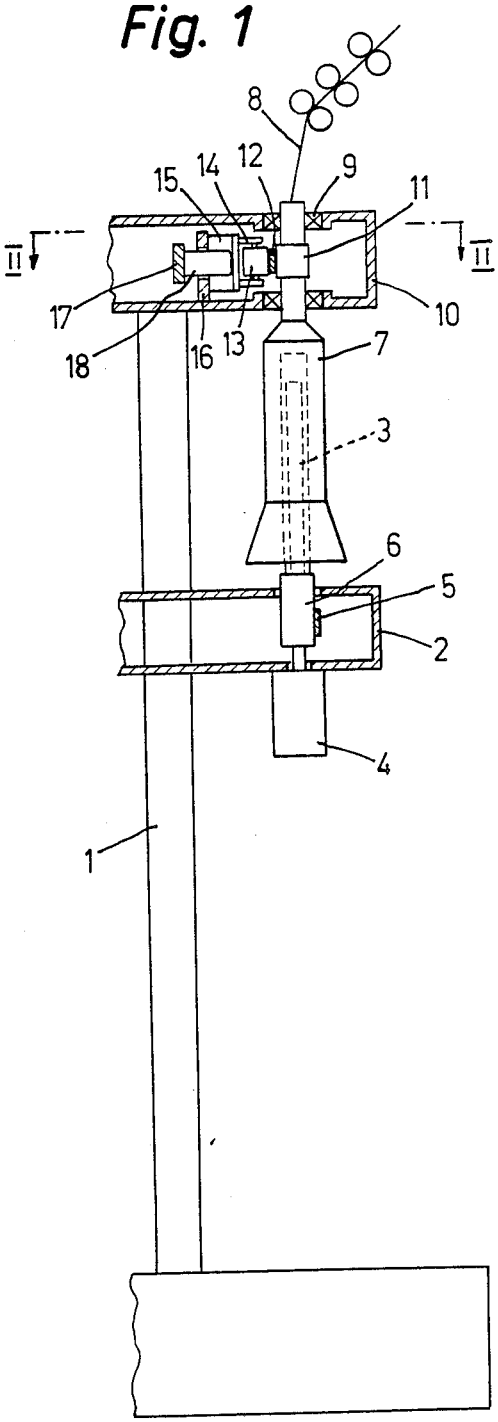
FIG. 1 is a schematic lateral view of a cap spinning machine, partially in section.

The illustrated cap spinning machine comprises a spindle bearing plate 2 carrying a series of spindles 3 and vertically displaceably guided on columns 1. The spindles 3 are supported respectively in a bearing 4 on the spindle bearing plate 2 to be rotatable about a vertical axis, and they are driven by a drive unit, e.g. a drive belt 5 in contact with a whorl 6 of each spindle 3, or, instead, by individual drive motors.

Each spindle 3 is associated with a cap-shaped thread guide member 7 rotatable about the spindle axis. A thread 8 delivered by a drafting system enters the thread guide member 7 from above, then passes through a guide aperture at the lower rim of the thread guide member 7, and travels to the bobbin seated on the spindle 3.

The thread guide members 7 are rotatably supported, in the upper neck region thereof, in bearings 9 in a bracket 10 carried by the columns 1, and they carry whorls 11 in contact with a belt 12, the latter being urged against the whorls 11 by a device applying contact pressure with an adjustable force.

The pressure device comprises, in the illustrated embodiment, pressure rollers 13 respectively in contact with the belt 12 between two adjacent whorls 11. One pressure roller 13 is adequate for respectively two whorls 11, as illustrated; however, it is also possible to provide a greater number of pressure rollers. The bearing 14 of each pressure roller 13 is in each case attached to a flexible shim 15, i.e. a small plate having a flexible, elastic section, the end of this plate being attached to a fixed supporting rail 16. In this way, each pressure roller 13 is guided to be movable transversely or approximately transversely with respect to the belt 12.

A joint control element in the form of a control rod 17 displaceable in parallel to the belt 12 is provided for moving the pressure rollers 13—and thus for varying the force with which the belt 12 is pressed against the whorls 11. Respectively one cam 18 is mounted on the control rod 17 for each of the shims 15. The shims 15 are inclined with respect to the belt 12 and thus represent a surface inclined to the belt 12, and respectively one of the cams 18 engages on their rear-face surfaces. Upon shifting of the control rod 17 with the cams 18 in the direction of arrow P in parallel to the traveling direction of the belt 12, the pressure rollers 13 are thereby moved toward the belt 12 against the elastic bending force of the small plates 15, and urge the belt more strongly against the whorls 11. The control rod 17 is moved by a dual-acting cylinder-piston unit 19. The displacement path of the control rod 17 is limited in both directions by respectively one adjustable stop 20 and 21.

Figure 2:
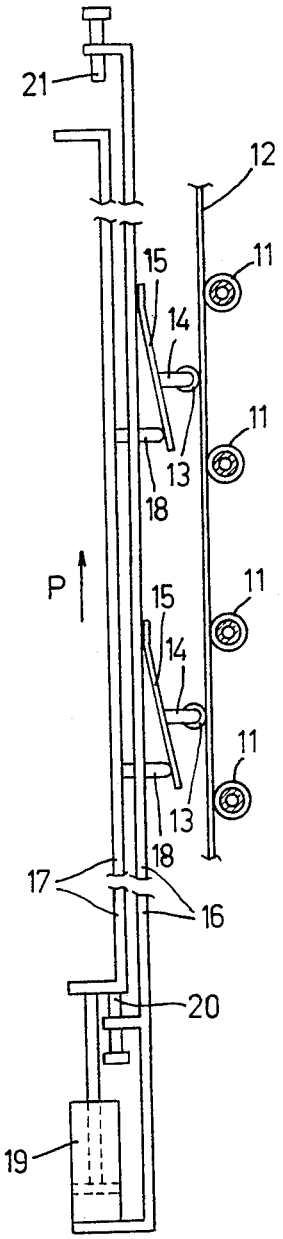
FIG. 2 is a horizontal section along line II—II in FIG. 1.

During operation of the spinning machine, the spindle drive belt 5 and the belt 12 are driven by a drive mechanism, not shown, at speeds that are in a constant relation to each other, namely in such a way that the linear velocity of the belt 12 is set to be somewhat lower than the tangential velocity of the peripheral surfaces of the whorls 11 disposed on the thread guide members 7 entrained by the threads. The belt 12 thus exerts a small braking action on the whorls 11 on account of friction. The size of the braking force is dependent on the force with which the pressure rollers 13 urge the belt 12 against the whorls 11. During spinning, the control rod 17 is located, as illustrated, in its end position at the end stop 20, at the bottom in FIG. 2, so that the pressure rollers 13 extend only a short distance across the path of the belt 12, i.e. exert only a small force on the belt 12. By adjustment of the end stop 20, whereby the cams 18 enter a different position along the inclined shims 15, the force exerted by the pressure rollers 13 on the belt 12, and thus the braking force exerted due to friction by the belt 12 on the whorls 11, can be varied and adapted to the conditions prevailing in a particular case, for example to the type of thread 8.

Upon shutoff of the spinning machine, the cylinder-piston unit 19 is actuated along with the cutoff and optionally braking of the drive mechanism for the belts 5 and 12, and thereby the control rod 17 is adjusted and/or shifted and/or moved with adequate speed into its other end position in contact with the end stop 21. During this step, the cams 18 move the pressure rollers 13, by way of the inclined shims 15, further toward the belt 12. The force with which the belt 12 is urged against the whorls 11 thereby becomes so great that the belt 12 can transmit to the whorls 11 the braking force required for braking the thread guide members 7—by friction or even by eliminating the slip between belt 12 and whorl 11.

The use of the joint control element 17 for moving the pressure rollers 13 is an expedient feature. However, the transmission of the movement of the control element 17 to the pressure rollers 13 could, of course, also take place differently than described in conjunction with the drawing. For example, each pressure roller 13 could be carried by an arm of a two-armed lever swingably arranged on the supporting rail 16, the other arms of these levers being articulated to a control rod movable in parallel to the belt 12. Alternatively, the bearings 14 of the pressure rollers 13 could be guided in the supporting rail 16 to be displaceable transversely to the belt 12 and could rest each on a ramp arranged on the displaceable control rod 17 and inclined with respect to the belt 12. Another possibility resides in joint control elements, movable in a different fashion, for the moving of pressure rollers guided to be movable transversely to the belt 12. The cams 18 could also be wedge shaped. The belt 12 can, of course, also be utilized solely for the startup and shutoff of the machine.

What is claimed is:

1. Cap spinning machine, with a series of rotatable spindles (3), each of these being associated with respectively one cap-shaped thread guide member (7) rotatable about the spindle axis, with a drive means (5) for rotating the spindles (3) and with a belt (12) in contact with whorls (11) arranged on the thread guide members (7), means (13, 14, 15) for urging the belt (12) against the whorls (11) with an adjustable force, said means for urging being shiftable between two end positions in one of which said force is maximum and in the other of which said force is minimum, and means responsive to shut off of said machine to shift said means into said end position of maximum force.

2. Cap spinning machine according to claim 1, characterized in that said means for urging (13, 14, 15) comprises pressure rollers (13) in contact with the belt (12) respectively between two mutually adjoining whorls (11), and means for moving said pressure rollers transversely to the belt (12).

3. Cap spinning machine according to claim 2, characterized in that a joint, movable control element (17) is provided for moving the pressure rollers (13), and means to move said control element to move the pressure rollers.

4. Cap spinning machine according to claim 3, characterized in that the control element (17) is a control rod movable in parallel to the belt (12), and means for moving said control rod parallel to the belt.

5. Cap spinning machine according to claim 4, characterized in that the control rod (17) is coupled with each of the pressure rollers (13) by way of respectively one surface (15) inclined with respect to the belt (12).

6. Cap spinning machine according to claim 4, characterized by two end stops, and means for shifting the control rod (17) between said two end stops (20, 21), at least one of these end stops being adjustable.

7. Cap spinning machine according to claim 1, characterized in that the spindle drive means (5) and the belt (12) can be driven at speeds that are in a constant relationship to each other.

* * * * *